US008807778B1

(12) United States Patent
Latchman et al.

(10) Patent No.: US 8,807,778 B1
(45) Date of Patent: Aug. 19, 2014

(54) LIGHTED HELMET ASSEMBLY

(76) Inventors: Dean Latchman, Chicago, IL (US); Glenda Latchman, Chicago, IL (US)

( * ) Notice: Subject to any disclaimer, the term of this patent is extended or adjusted under 35 U.S.C. 154(b) by 40 days.

(21) Appl. No.: 13/476,081

(22) Filed: May 21, 2012

(51) Int. Cl.
*F21V 21/084* (2006.01)

(52) U.S. Cl.
USPC ..... 362/106; 362/105

(58) Field of Classification Search
CPC ..... A42B 3/044; A42B 1/244
USPC ..... 340/475–479; 362/105, 106, 103, 362/249.01, 249.02, 227, 570; 2/171, 205, 2/909, 206, 410, 5, 6.1, 422, 424, 425; 315/313
See application file for complete search history.

(56) References Cited

U.S. PATENT DOCUMENTS

| | | | | |
|---|---|---|---|---|
| 4,559,516 | A | 12/1985 | Schott et al. | |
| 4,559,586 | A * | 12/1985 | Slarve | 362/106 |
| 4,648,131 | A * | 3/1987 | Kawaguchi et al. | 398/127 |
| 4,891,736 | A | 1/1990 | Gouda | |
| 4,956,752 | A | 9/1990 | Foglietti | |
| 5,416,675 | A * | 5/1995 | DeBeaux | 362/106 |
| 5,517,698 | A * | 5/1996 | Nault et al. | 2/424 |
| 5,871,271 | A | 2/1999 | Chien | |
| D424,247 | S | 5/2000 | Deleon | |
| 6,097,287 | A | 8/2000 | Lu | |
| 6,406,168 | B1 * | 6/2002 | Whiting | 362/473 |
| 6,784,795 | B1 * | 8/2004 | Pories et al. | 340/479 |
| 6,826,783 | B1 * | 12/2004 | Grove et al. | 2/424 |
| D502,420 | S | 3/2005 | Dent et al. | |
| 6,982,633 | B2 | 1/2006 | Burdick | |
| 8,334,762 | B2 * | 12/2012 | Szeljack | 340/475 |
| 2001/0039674 | A1 * | 11/2001 | Shida | 2/414 |
| 2002/0085727 | A1 * | 7/2002 | Paritsky et al. | 381/172 |
| 2003/0137413 | A1 * | 7/2003 | Morse | 340/468 |
| 2004/0227628 | A1 * | 11/2004 | Burdick | 340/479 |
| 2005/0275193 | A1 * | 12/2005 | Lee | 280/468 |
| 2009/0073679 | A1 * | 3/2009 | Wainright | 362/191 |
| 2010/0134272 | A1 * | 6/2010 | Palacios | 340/475 |
| 2010/0181940 | A1 * | 7/2010 | Bucalo | 315/313 |
| 2013/0125294 | A1 * | 5/2013 | Ferrara | 2/411 |

FOREIGN PATENT DOCUMENTS

FR 2610484 A1 * 8/1988

OTHER PUBLICATIONS

Abstract FR 2610484 A1 Aug. 1988 Degoin Emmanuel.*

* cited by examiner

*Primary Examiner* — Sikha Roy
*Assistant Examiner* — Glenn Zimmerman

(57) ABSTRACT

A lighted helmet assembly is provided for enhancing visibility of the wearer for safety and providing signals of the intended direction of travel of the user. The assembly includes a curved shell having a bottom opening such that the shell is configured for fitting over and around a human head. The shell has an interior surface and an exterior surface. A liner is coupled to the interior surface and a plurality of lights is coupled to the exterior surface of the shell. The plurality of lights includes a plurality of directional lights, each being selectively activated to indicate an intended direction of travel by a user wearing the shell.

19 Claims, 6 Drawing Sheets

LIGHTED HELMET ASSEMBLY

BACKGROUND OF THE DISCLOSURE

Field of the Disclosure

The disclosure relates to protective helmet devices and more particularly pertains to a new protective helmet device for enhancing visibility of the wearer for safety and providing signals of the intended direction of travel of the user.

SUMMARY OF THE DISCLOSURE

An embodiment of the disclosure meets the needs presented above by generally comprising a curved shell having a bottom opening such that the shell is configured for fitting over and around a human head. The shell has an interior surface and an exterior surface. A liner is coupled to the interior surface and a plurality of lights is coupled to the exterior surface of the shell. The plurality of lights includes a plurality of directional lights, each being selectively activated to indicate an intended direction of travel by a user wearing the shell.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
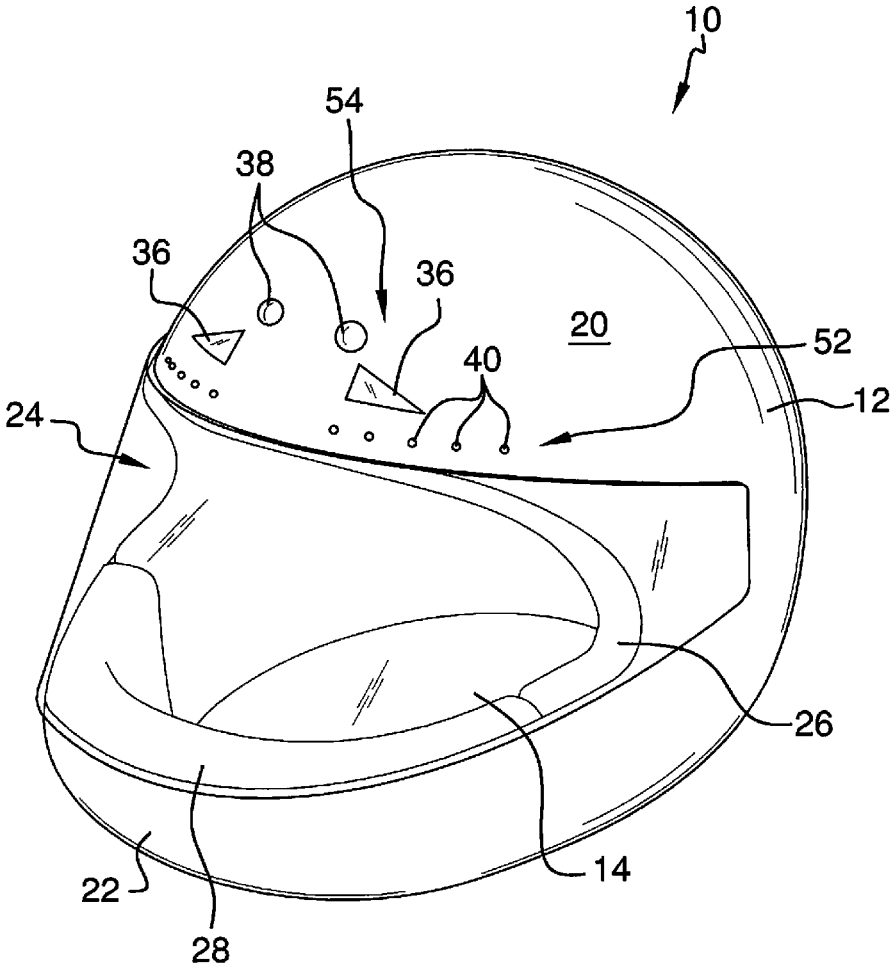
FIG. 1 is a top front side perspective view of a lighted helmet assembly according to an embodiment of the disclosure.
Figure 2:
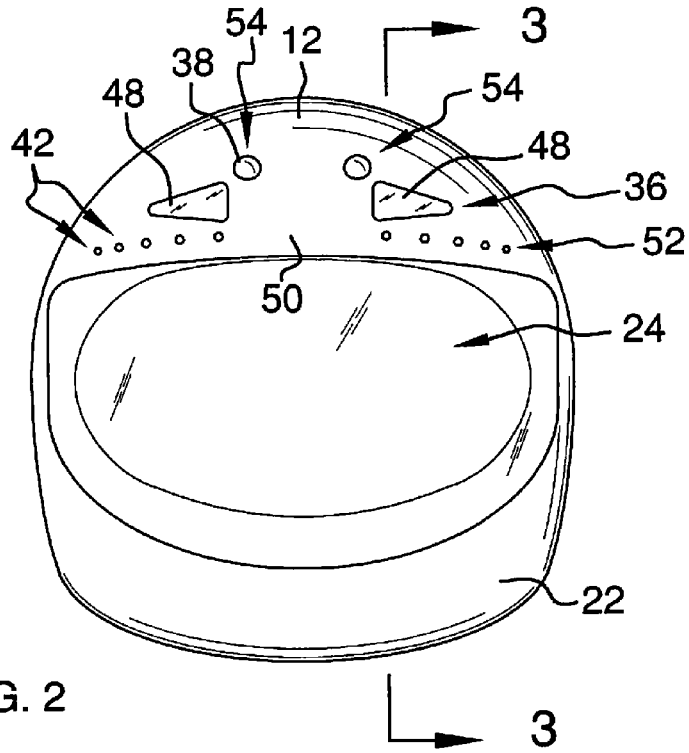
FIG. 2 is a front view of an embodiment of the disclosure.
Figure 3:
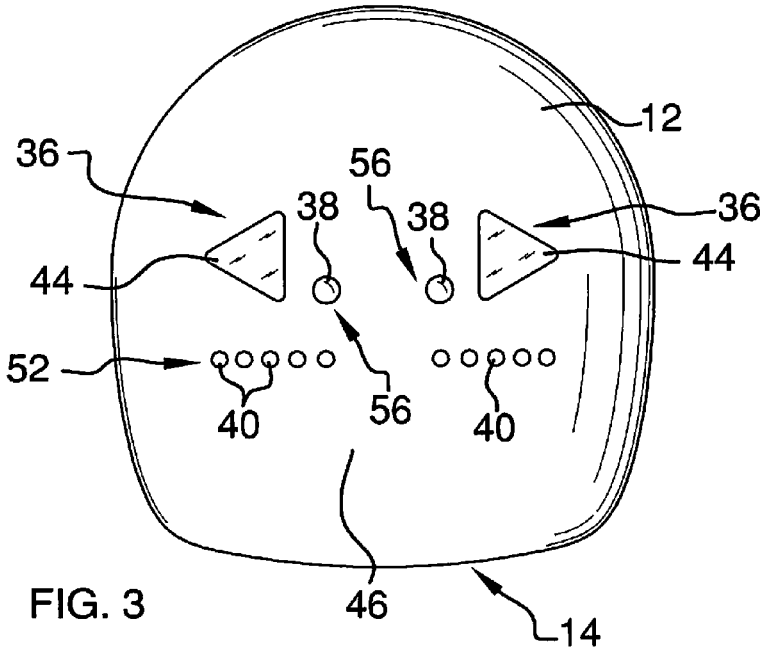
FIG. 3 is a back view of an embodiment of the disclosure.
Figure 4:
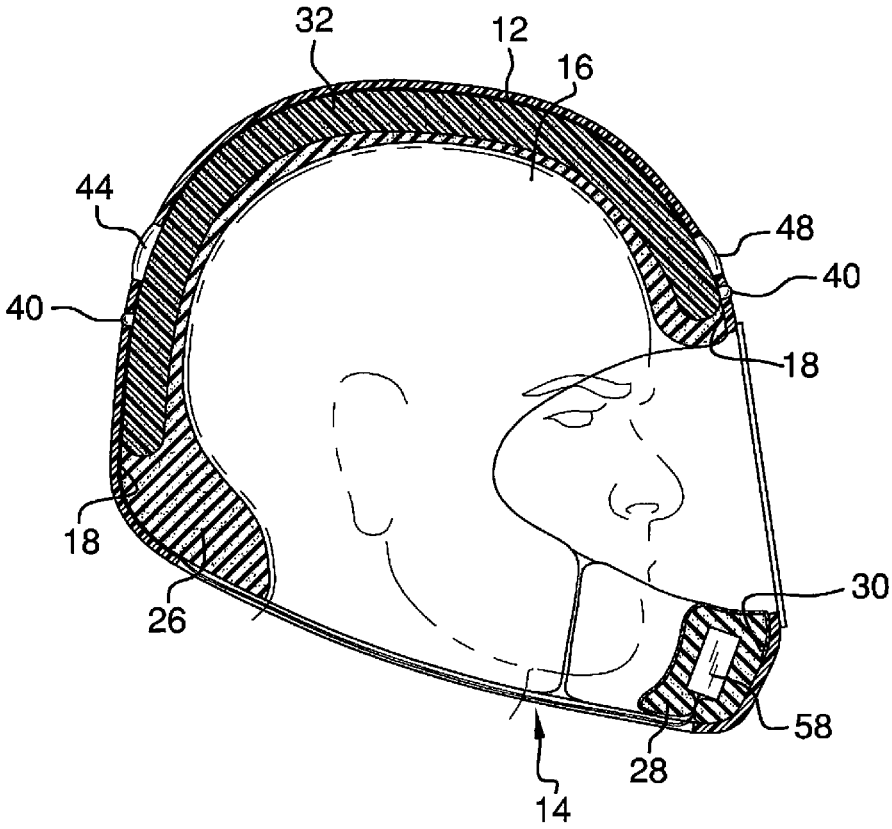
FIG. 4 is a cross-sectional view of an embodiment of the disclosure taken along line 4-4 of FIG. 2.
Figure 5:
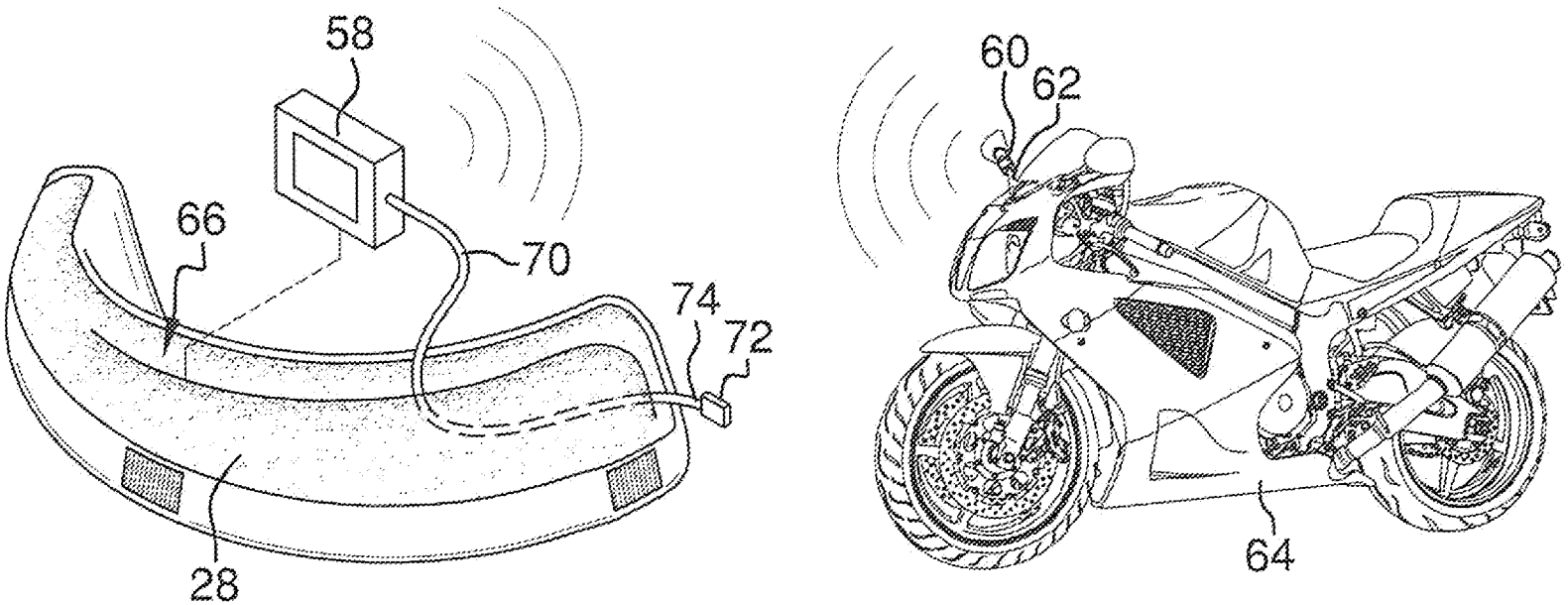
FIG. 5 is a top front side perspective view of an embodiment of the disclosure.
Figure 6:
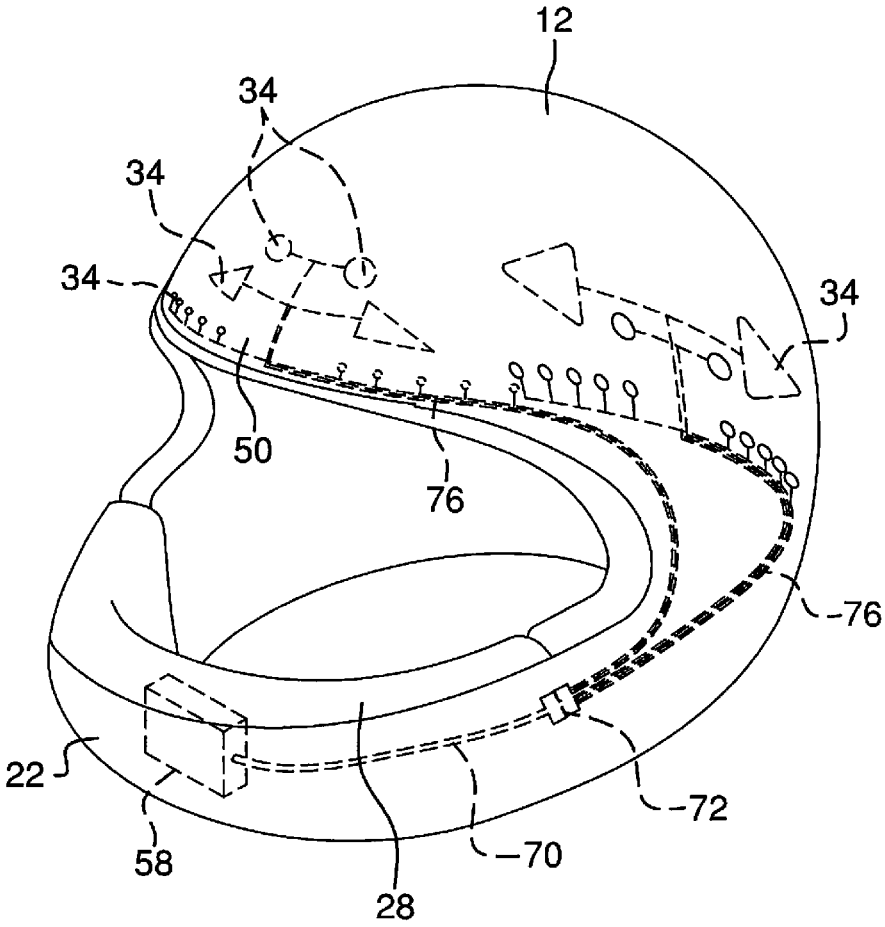
FIG. 6 is a top front side perspective view of an embodiment of the disclosure.
Figure 7:
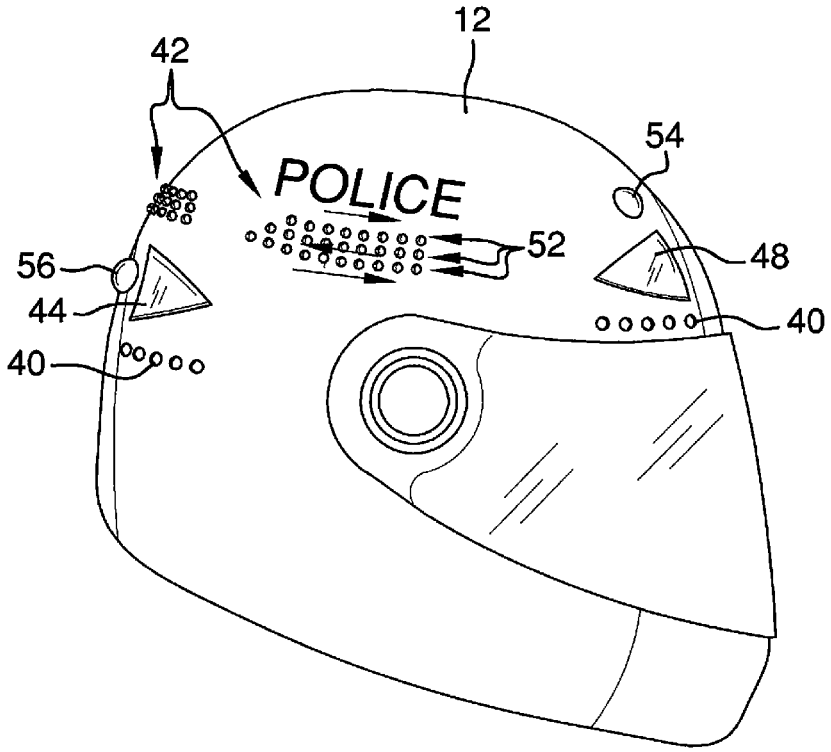
FIG. 7 is a side view of an alternate embodiment of the disclosure.

With reference now to the drawings, and in particular to FIGS. 1 through 7 thereof, a new protective helmet device embodying the principles and concepts of an embodiment of the disclosure and generally designated by the reference numeral 10 will be described.

As best illustrated in FIGS. 1 through 7, the lighted helmet assembly 10 generally comprises a curved shell 12 constructed of a hard shatter resistant material. The shell 12 has a bottom opening 14 such that the shell 12 is configured for fitting over and around a human head 16. The shell 12 has an interior surface 18, an exterior surface 20, and may include a jaw portion 22 and a face opening 24. The jaw portion 22 extends between the bottom opening 14 and the face opening 24. Alternatively, the bottom opening 14 and the face opening 24 may be incorporated into a single opening surrounding the neck and face of a wearer. A liner 26 is coupled to the interior surface 18 of the shell 12. The liner 26 may be constructed of a soft foam for comfort and protection of the wearer. The liner may include a removable jaw section 28 covering an interior surface 30 of the jaw portion 22 of the shell 12. A protective layer 32 may be provided between the liner 26 and the interior surface 18 of the shell 12. The protective layer 32 may be constructed of a stiff foam or other material to assist in absorbing impact in the event of an accident. A plurality of lights 34 is coupled to the exterior surface 20 of the shell 12. The plurality of lights 34 includes a plurality of directional lights 36, and may also include a plurality of primary safety lights 38, secondary safety lights 40 and flasher lights 42.

Each of the directional lights 36 is selectively activated to indicate an intended direction of travel by a user wearing the shell 12 as a helmet while on a vehicle. The directional lights 36 include a pair of rear turn lights 44. Each of the rear turn lights 44 is positioned on a rear portion 46 of the shell 12 and shaped to point towards an associated side of the shell 12. The directional lights 36 also include a pair of front turn lights 48 positioned on a front portion 50 of the shell 12. Each of the front turn lights 48 is also shaped to point towards an associated side of the shell 12.

The primary safety lights 38 may be selectively activated to enhance visibility of the shell 12. The primary safety lights 38 may be front and back pairs 54,56 respectively of constantly illuminated lights. The lights 38 of each pair may be positioned in spaced relationship such that one of each pair 54,56 is visible when viewed directly from each side of the shell 12 as exemplified in FIG. 7. The primary safety lights 38 may further be spaced such that at least two of the primary safety lights 38 are visible from any angle around the shell 12.

The secondary safety lights 40 and flasher lights 42 may also be positioned on the shell 12. Each of the secondary safety lights 40 may be smaller than the primary safety lights 38 and arranged into light rows 52. The secondary safety lights 40 may be separate from the flasher lights 42, include flasher lights 42 or may all be intermittently activated such that the secondary safety lights 40 define the flasher lights 42 alternating between activation and deactivation.

A receiver 58 is coupled to the shell 12. The receiver 58 is operationally coupled to the plurality of lights 34 coupled to the shell 12. A transmitter 60 is operationally coupled to the receiver 58 preferably utilizing a wireless signal for selectively illuminating each of the lights 34. The transmitter 60 may be configured for coupling to handlebars 62 on a motorcycle 64. Alternatively, the shell 12 may be worn by a person riding a skateboard, snowboard, four-wheeler, scooter or any other transport device in which a safety helmet is worn. In some of these applications a hand-held transmitter or switch positioned on or in the shell 12 may be utilized.

When the removable jaw section 28 is employed, a pocket 66 may be positioned in the jaw section 28 of the liner 26. The receiver 58 can be positioned in the pocket 66 to securely hold the receiver 58 within the shell 12. A plurality of hook and loop fasteners 68 may be attached to the jaw section 28 for coupling the jaw section of the liner 26 to the shell 12. A wire 70 extends from the receiver 58 and a connector 72 is coupled to a distal end 74 of the wire 70 relative to the receiver 58. The connector 72 is detachably coupled to wiring 76 operationally coupled to the lights 34.

In an embodiment, the flasher lights 42 may alternate between a plurality of colors including blue, red and white conventionally used to indicate the user is a law enforcement officer. The positions of the lights 34 and more particularly the flasher lights 42 may be varied as desired and a flashing pattern may be pre-programmed to closer resemble flashing lights on a law enforcement vehicle including having multiple light rows 52 with the flasher lights 42 activating in sequence along opposite directions for adjacently positioned rows 52.

In use, the shell 12 is worn on the head 16 of a user and the primary safety lights 38 are constantly illuminated to enhance visibility of the user, particularly in low light conditions. The directional lights 36 are selectively activated by use of the transmitter 60 and receiver 58.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A lighted helmet assembly comprising:

a curved shell having a bottom opening such that said shell being configured for fitting over and around a human head, said shell having an interior surface and an exterior surface;

a liner coupled to said interior surface; and a plurality of lights coupled to said exterior surface of said shell, said plurality of lights including a plurality of directional lights, each of said directional lights being selectively activated to indicate an intended direction of travel by a user wearing said shell;

a receiver coupled to said shell, said receiver being operationally coupled to said plurality of lights coupled to said shell;

a transmitter operationally coupled to said receiver for selectively illuminating each of said plurality of lights;

said shell having a jaw portion and a face opening, said jaw portion extending between said bottom opening and said face opening;

said liner having a removable jaw section covering an interior surface of said jaw portion of said shell; and a pocket positioned in said jaw section of said liner, said receiver being positioned in said pocket.

2. The assembly of claim 1, further including said plurality of directional lights including a pair of rear turn lights, each of said rear turn lights being positioned on a rear portion of said shell, each of said rear turn lights being shaped to point towards an associated side of said shell.

3. The assembly of claim 1, further including said plurality of directional lights including a pair of front turn lights, each of said front turn lights being positioned on a front portion of said shell, each of said front turn lights being shaped to point towards an associated side of said shell.

4. The assembly of claim 1, further including a plurality of hook and loop fasteners coupling said jaw section of said liner to said shell.

5. The assembly of claim 1, further comprising:

a wire extending from said receiver; and a connector coupled to a distal end of said wire relative to said receiver, said connector being detachably coupled to wiring operationally coupled to said plurality of lights.

6. The assembly of claim 1, further including a protective layer coupled to said shell, said protective layer being positioned between said liner and said interior surface of said shell.

7. The assembly of claim 1, further including said transmitter being configured for coupling to handlebars on a motorcycle.

8. The assembly of claim 1, further including said plurality of lights including a plurality of primary safety lights, said primary safety lights being selectively activated to enhance visibility of said shell.

9. The assembly of claim 8, further including said plurality of lights including a plurality of secondary safety lights positioned on said shell, each of said secondary safety lights being smaller than said primary safety lights.

10. The assembly of claim 9, further including said plurality of secondary safety lights being arranged into light rows.

11. The assembly of claim 1, further including said plurality of lights including a plurality of flasher lights, said flasher lights alternating between activation and deactivation.

12. The assembly of claim 11, further including said flasher lights alternating between a plurality of colors whereby said flasher lights are configured to indicate the user is a law enforcement officer.

13. A lighted helmet assembly comprising:

a curved shell having a bottom opening such that said shell being configured for fitting over and around a human head, said shell having an interior surface and an exterior surface, said shell having a jaw portion and a face opening, said jaw portion extending between said bottom opening and said face opening;

a liner coupled to said interior surface, said liner having a removable jaw section covering an interior surface of said jaw portion of said shell;

a protective layer coupled to said shell, said protective layer being positioned between said liner and said interior surface of said shell;

a plurality of lights coupled to said exterior surface of said shell, said plurality of lights including a plurality of directional lights, each of said directional lights being selectively activated to indicate an intended direction of travel by a user wearing said shell, said plurality of directional lights including a pair of rear turn lights, each of said rear turn lights being positioned on a rear portion of said shell, each of said rear turn lights being shaped to point towards an associated side of said shell, said plurality of directional lights including a pair of front turn lights, each of said front turn lights being positioned on a front portion of said shell, each of said front turn lights being shaped to point towards an associated side of said shell, said plurality of lights including a plurality of primary safety lights, said primary safety lights being selectively activated to enhance visibility of said shell, said plurality of lights including a plurality of secondary safety lights positioned on said shell, each of said secondary safety lights being smaller than said primary safety lights, said plurality of secondary safety lights being arranged into light rows, said plurality of lights including a plurality of flasher lights, said flasher lights alternating between activation and deactivation;

a receiver coupled to said shell, said receiver being operationally coupled to said plurality of lights coupled to said shell;

a transmitter operationally coupled to said receiver for selectively illuminating each of said plurality of lights, said transmitter being configured for coupling to handlebars on a motorcycle;

a pocket positioned in said jaw section of said liner, said receiver being positioned in said pocket;

a plurality of hook and loop fasteners coupling said jaw section of said liner to said shell;

a wire extending from said receiver; and a connector coupled to a distal end of said wire relative to said receiver, said connector being detachably coupled to wiring operationally coupled to said plurality of lights.

14. A lighted helmet assembly comprising:

a curved shell having a bottom opening such that said shell being configured for fitting over and around a human head, said shell having an interior surface and an exterior surface;

a liner coupled to said interior surface;

a plurality of lights coupled to said exterior surface of said shell, said plurality of lights including a plurality of directional lights, each of said directional lights being selectively activated to indicate an intended direction of travel by a user wearing said shell;

said plurality of lights including a plurality of primary safety lights, said primary safety lights being selectively activated to enhance visibility of said shell; and said plurality of lights including a plurality of secondary safety lights positioned on said shell, each of said secondary safety lights being smaller than said primary safety lights.

15. The assembly of claim 14, further including said plurality of directional lights including a pair of rear turn lights, each of said rear turn lights being positioned on a rear portion of said shell, each of said rear turn lights being shaped to point towards an associated side of said shell.

16. The assembly of claim 14, further including said plurality of directional lights including a pair of front turn lights, each of said front turn lights being positioned on a front portion of said shell, each of said front turn lights being shaped to point towards an associated side of said shell.

17. The assembly of claim 14, further comprising:

a receiver coupled to said shell, said receiver being operationally coupled to said plurality of lights coupled to said shell; and a transmitter operationally coupled to said receiver for selectively illuminating each of said plurality of lights.

18. The assembly of claim 17, further including said transmitter being configured for coupling to handlebars on a motorcycle.

19. The assembly of claim 14, further including said plurality of secondary safety lights being arranged into light rows.

* * * * *